United States Patent [19]

Smith

[11] Patent Number: 4,697,537

[45] Date of Patent: Oct. 6, 1987

[54] RETRACTABLE LINE STORAGE DEVICE

[76] Inventor: Thomas C. Smith, 1820 Forney Dr., Huntsville, Ala. 35816

[21] Appl. No.: 856,770

[22] Filed: Apr. 28, 1986

[51] Int. Cl.[4] ..... B63B 21/04

[52] U.S. Cl. ..... 114/230; 242/86.5 R; 242/107

[58] Field of Search ..... 114/210, 230, 254, 364, 114/218; 242/86.5 R, 86.5 A, 106, 107, 107.2

[56] References Cited

U.S. PATENT DOCUMENTS

| | | | |
|---|---|---|---|
| 1,811,400 | 6/1931 | McClellan | 114/230 |
| 3,193,212 | 7/1965 | Lotta | 242/107 |
| 3,851,613 | 12/1974 | Armour | 114/230 |

*Primary Examiner*—Sherman D. Basinger
*Attorney, Agent, or Firm*—George J. Porter

[57] ABSTRACT

A retractable line storage device (10) is disclosed. Most particularly the device provides a storage and automatic retrieval device for mooring lines as used on small boats. A hollow housing (18) and more specifically its spindle 26 is adapted to retain reel (28). A mooring line (14) is secured to and wrapped around the reel. The free end of the mooring line passes through top plate (12) and is attached to semi-spherical handgrip (16). A cup (15) is formed in the upper surface of top plate (12) for reception of the handgrip thus providing a flush mounting wherein no part of the device protrudes above the surface of top plate (12) when the line is in its retracted position. Finger grip sumps (19) are provided for access to the fingergrip. A helical spring (31) is attached to housing (18) and to reel (28) for automatic rewinding of the line (14) when storage of the line is desired. A cover plate (29) is provided to facilitate access to the parts contained within housing (18).

3 Claims, 10 Drawing Figures

RETRACTABLE LINE STORAGE DEVICE

TECHNICAL FIELD

The present invention relates to a retractable line storage device and more particularly to a rectractable storage device for mooring lines as are commonly used in small boats.

BACKGROUND OF THE INVENTION

As well known by users of small boats, the storage of mooring lines in an out of the way, yet convenient location, has long been a problem.

The use of retractable line storage devices has provided at least a partially satisfactory solution to this problem in some cases. Devices of a configuration somewhat similar to the present invention are illustrated in U.S. Pat. Nos. 1,811,400 to W. D. McClellan, 3,395,668 to R. A. George and 3,851,613 to Phillip D. Armour.

While these devices appear to work quite well, in practice serious shortcomings have been noted.

It is well known that many modern boats utilize a unitary or composite type construction wherein all voids are filled with flotation. This type of construction precludes access to the undersides of decks and gunwales. Review of the prior art devices shows that in all cases they are designed for older type boats wherein the need for access to the underside of the mounting surface does not present a serious problem. It is clear that the prior art devices could not be mounted on boats which utilize a unitized or composite type construction or on any boat which does not provide easy access to the underside of the mounting surface.

A further disadvantage of the prior art is that these devices seek to provide cleats or fasteners for mooring the boats to which they are attached. However commendable this function would appear, in practice it has been shown that such devices are not only expensive, but they are neither strong enough nor well based enough to withstand the severe pressures that are often placed on boat cleats.

A further disadvantage of the prior art devices is that they protrude above the mounting surface and provide an unnecessary safety hazard in addition to that provided by existing necessary cleats.

The present invention eliminates these disadvantages by providing a retractable line storage device which may be mounted totally from the outside of any surface and placed adjacent an existing well founded cleat.

Thus, a line storage device is provided which is totally out of the way and which may be mounted conveniently for use in conjunction with existing cleats which are standard equipment on small boats.

While the present invention is particularly well suited for use on new boats utilizing unitary or composite construction, it is clear that it is also much more stable for after market installation on such boats than any known prior art device.

In view of the foregoing discussion, it will be apparent that the prior art devices do not provide the advantages found in the present invention.

It is therefore an object of this invention to provide a retractble line storage container which may be mounted to any surface from the outside of said surface without access to the underside of the mounting surface.

It is a further object of this invention to provide a retractable line storage container which is flush mounted to any boat surface thus providing the safest possible working surface wherein no part of the device protrudes above its upper face.

It is yet another object of this invention to provide a retractable line storage container which may be conveniently located adjacent any existing boat cleat or other fastening device.

Still another object of this invention is to provide a retractable line storage container which utilizes a minimum number of parts and is therefore at once inexpensive to build and install, and simple to operate.

Yet another object of this invention is to provide a retractable line storage container which is easily and quickly removeable for repair or maintenance.

SUMMARY OF THE INVENTION

The present invention is a retractable line storage container for use primarily in small boats. The invention comprises: a hollow housing for reception of a rotatable spring operated spool; a mounting plate which attaches to the upper end of said housing, said mounting plate having a thickened portion which is provided with a cup, a finger sump and a hole in the bottom of said cup; a mooring line attached at one end to the spool within said housing, its free end passing around the spool and out the hole in the mounting plate; the spring is attached to the spool and to the housing for rotating the spool and thus retracting the line; a handgrip is attached to the free end of said line to provide means for extracting the line; the handgrip is adapted to seat within the cup portion of said mounting plate and includes a relieved portion for flush reception of a knot or fastening device for attaching the free end of the line to the handgrip.

DETAILED DESCRIPTION OF THE INVENTION

The invention is a mooring line storage and retracting device 10, used for mooring a motor boat 11 to a pier.

Figure 1:
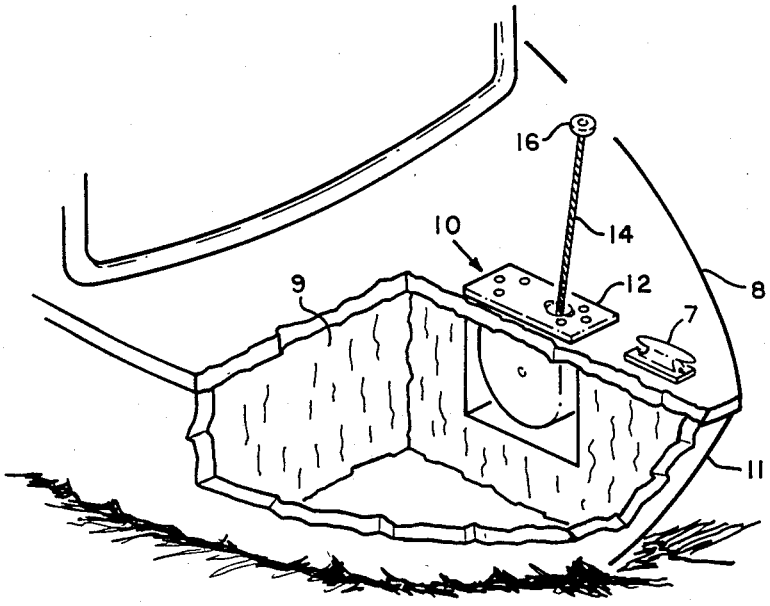
FIG. 1 is a perspective view of a boat with the invention attached to the forward top deck of the boat.
Figure 2:
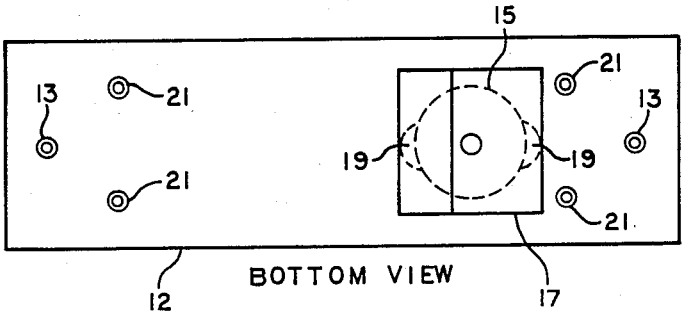
FIG. 2 is a bottom view of the top plate of the retractable line storage device.
Figure 3:
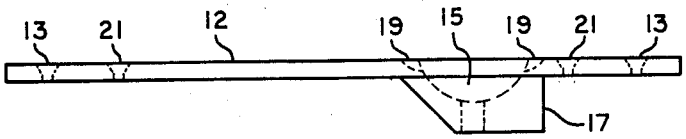
FIG. 3 is a side view of the top plate shown in FIG. 2.
Figure 4:
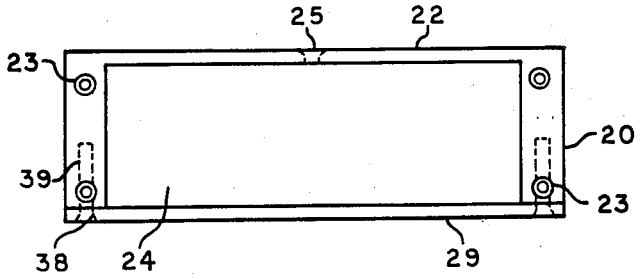
FIG. 4 is a plan view of the case of the retractable line storage device.

As may be seen in FIG. 1, the mooring device 10 is embedded in the deck 8 and flotation 9 of the boat 11 with the top plate 12 of the device 10 resting on the deck of the boat 11 adjacent a mooring cleat 7. As best illustrated in FIGS. 2 and 3, top plate 12 is fastened to boat 11 by screws (not shown) projecting through screwholes 13. One end of the mooring line 14 comes out of the top plate 12 and has a "half ball" handgrip 16 attached to the end of the mooring line 14. When mooring line 14 is retracted, handgrip 16, which is semi-spherical in shape, rests in a semi-spherical cup 15 cut into the top of top plate 12. Top plate 12 has an enlarged, extra-thick portion 17 which provides enough depth for cup 15 and a hole at its bottom portion to be milled out of the top plate 12. On two sides of cup 15, finger grip sumps 19 are also milled out of the top plate 12.

Looking now at FIGS. 1 through 5, the case 18 is attached to the top plate 12 by bolts (not shown) projecting through four screwholes 21 and into boltholes 23 in a narrow case wall 20. Housing 18 extends downward below the deck 8 into the flotation 9, which is normally found below the decks of modern small boats. The housing 18 includes an integral, D-shaped center case wall 20 and an integral wide back side 22, which together form a cavity 24. Attached to the back side 22 by a machine bolt (not shown) running through bolthole 25 in the center of cavity 24 is a reel spindle 26, which extends laterally from the center of back side 22 through cavity 24. Cavity 24 is closed on the front side by a large "D" shaped, flat, wide cover plate 29, which is attached by bolts (not shown) which pass through boltholes 38 in the cover 29 and into threaded holes 39 in the case 18. The cover 29 thus constitutes the front wall of housing 18.

Figure 5:
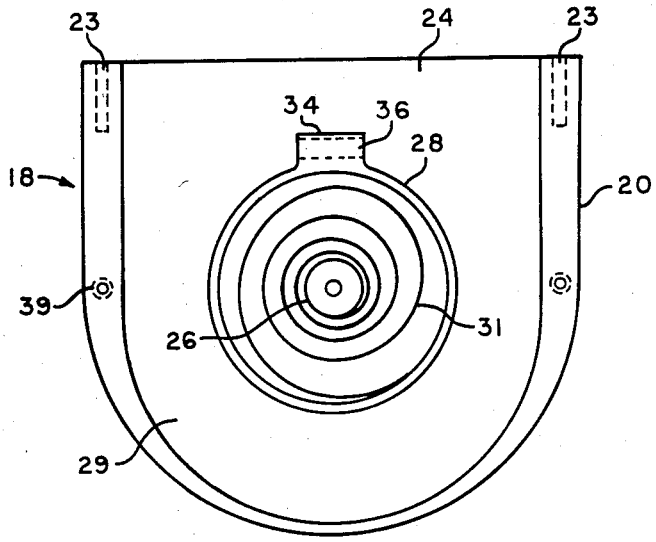
FIG. 5 is a side view of the case of the retractable line storage device shown in FIG. 4.
Figure 6:
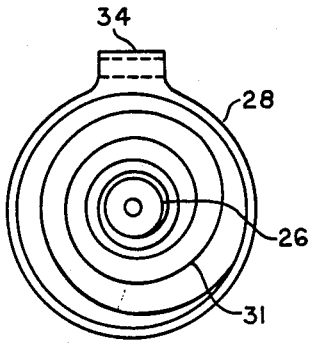
FIG. 6 is a front view of the reel for the retractable line storage device.
Figure 7:
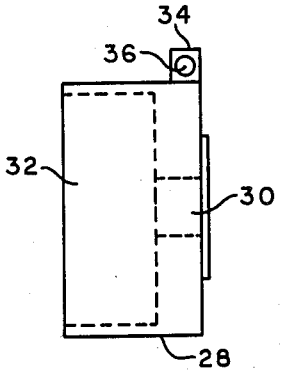
FIG. 7 is a side view of the reel for the retractable line storage device, as shown in FIG. 6.
Figure 8:
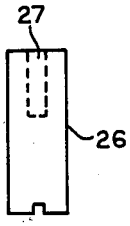
FIG. 8 is a side view of the reel spindle for the retractable line storage device.

As shown in FIGS. 5, 6 and 7, reel 28 has a center hole 30 which fits over spindle 26 and allows reel 28 to fit into cavity 24 and occupy the center portion of cavity 24. Reel 28 contains a helical retracting spring 31, housed in spring cavity 32. Reel 28 also has a projection 34 extending from one side of its outer circumference. A hole 36, drilled through projection 34, provides a tie point for attaching one end of the mooring line 14 to the reel 28.

Figure 9:
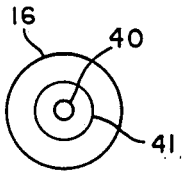
FIG. 9 is a plan view of the handgrip attached to the mooring line.
Figure 10:
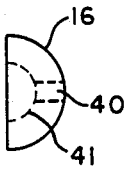
FIG. 10 is a side view of the handgrip shown in FIG. 9.

FIGS. 9 and 10 show the handgrip 16 in plan view and side view, respectively. Handgrip 16 has a hole 40 bored through it to accommodate mooring line 14. One end of mooring line 14 may be knotted or enlarged as with a conventional line clamp for insertion into the relieved portion 41 of the handgrip 16 to prevent mooring line 14 pulling through handgrip 16. Relieved portion 41 thus permits attachment of the line 14 to the hand grip 16 with no protrusion above the upper flat surface of handgrip 16.

To operate the mooring line holder and retracting device 10, one simply grasps the handgrip 16 and pulls out the mooring line 14 to the desired length, so that mooring line 14 may be used to secure the boat by tying the line to a convenient cleat and to a mooring post on the pier. When the mooring line 14 is untied and released, it automatically retracts into case 18 and winds itself on the outside of reel 28. An automatic or manual reel stopping device of conventional design may also be used if desired.

What is claimed is:

1. A retractable line storage container comprising:

a housing having an open upper end and closed lower end, a pair of narrow side walls and a pair of wide side walls connected to said ends so as to form a hollow area within said housing, one of said wide side walls being detachable;

a mounting plate attached to the open upper end of said housing, said plate having a line passage hole therethrough, said mounting plate being larger in all lateral dimensions than the lateral dimensions of the upper end of said housing, said mounting plate having mounting holes therein, each of said mounting holes being located outwardly from said housing;

a reel rotatably mounted within said hollow area;

a line attached at one end to said reel so as to be stored on said reel by rotation of said reel, the other end of said line being a free end and passing through the line passage hole in said mounting plate;

spring means attached between said housing and said reel for rotating said reel and thereby retracting said line into said housing; and a handgrip attached to the free end of said line, said handgrip being larger than said line passage hole so as to prevent retraction of the free end of said line within said housing; said mounting plate including a thickened portion containing a cup for reception of said handgrip, and finger grip sumps adjacent said cup, whereby said handgrip may be accessed for removal from said cup.

2. The retractable line storage container as set forth in claim 1 wherein said handgrip is semi-spherical in shape so as to fit closely within said cup and to be flush with the upper surface of said mounting plate.

3. The retractable line storage container as set forth in claim 2 wherein said handgrip includes a relieved portion for reception of a fastening means for attachment of said line to said handgrip whereby no portion of the line or its fastening means protrudes above said relieved portion.

* * * * *